US005601697A

United States Patent [19]

Miller et al.

[11] Patent Number: 5,601,697

[45] Date of Patent: Feb. 11, 1997

[54] DEMETALLATION-HIGH CARBON CONVERSION PROCESS, APPARATUS AND ASPHALT PRODUCTS

[75] Inventors: Charles B. Miller, Ashland; Howard F. Moore, Catlettsburg; David P. Wesley, Ashland; Robert H. Wombles, Ashland; Carlton H. Jewitt, Catlettsburg; Roger E. Hayner, Flatwoods, all of Ky.; Willian H. Gilkerson, Sr., Huntington, W. Va.; Charles R. Gannon, Ashland, Ky.

[73] Assignee: Ashland Inc., Ashland, Ky.

[21] Appl. No.: 286,714

[22] Filed: Aug. 4, 1994

[51] Int. Cl.[6] ..... C10C 3/08

[52] U.S. Cl. ..... 208/945; 208/41; 208/39

[58] Field of Search ..... 208/45, 39, 41

[56] References Cited

U.S. PATENT DOCUMENTS

| | | | |
|---|---|---|---|
| 1,231,695 | 7/1917 | Bell . | |
| 1,437,587 | 12/1922 | Eddy . | |
| 1,622,573 | 3/1927 | Cross . | |
| 2,770,576 | 11/1956 | Pratt | 196/14.46 |
| 3,423,308 | 1/1969 | Murphy | 208/309 |
| 3,462,359 | 8/1969 | Fauber | 208/23 |
| 3,627,675 | 12/1971 | Ditman | 208/309 |
| 3,748,261 | 7/1973 | Watkins | 208/210 |
| 3,793,189 | 2/1974 | Corbett | 208/23 |
| 3,796,653 | 3/1974 | Gatsis | 208/95 |
| 3,830,732 | 8/1974 | Gatsis | 208/309 |
| 4,088,540 | 5/1978 | Bunas | 196/14.52 |
| 4,125,459 | 11/1978 | Garwin | 208/309 |
| 4,207,117 | 6/1980 | Espenscheid et al. | 106/278 |
| 4,376,038 | 3/1983 | Myers | 208/113 |
| 4,400,264 | 8/1983 | Kwant et al. | 208/68 |
| 4,405,441 | 9/1983 | Van Dongen et al. | 208/61 |
| 4,500,416 | 2/1985 | van Dongen et al. | 208/86 |
| 4,521,277 | 6/1985 | Calderon et al. | 196/46 |
| 4,673,486 | 6/1987 | Orihashi et al. | 208/86 |
| 4,686,027 | 8/1987 | Bonilla et al. | 208/39 |
| 4,851,260 | 7/1989 | Stone | 427/138 |
| 5,059,300 | 10/1991 | McGinnis | 208/44 |
| 5,118,733 | 6/1992 | Gelles et al. | 524/68 |
| 5,135,640 | 8/1992 | Vizner | 208/92 |
| 5,145,574 | 9/1992 | Hedrick | 208/45 |

FOREIGN PATENT DOCUMENTS

| | | |
|---|---|---|
| 3243378 | 7/1979 | Australia . |
| 213683 | 9/1984 | Germany . |
| 220038 | 3/1985 | Germany . |
| 57-78488 | 3/1982 | Japan . |
| 6116499 | 4/1994 | Japan . |
| 992639 | 4/1981 | Russian Federation . |

OTHER PUBLICATIONS

"Solvent treat resids", V. A. Gearhart, Hydrocarbon Processing, May 1980, pp. 150–151.

"Deasphalting", Hydrocarbon Processing, Nov. 1992, p. 159.

*Primary Examiner*—Helane Myers

*Attorney, Agent, or Firm*—Richard C. Willson, Jr.

[57] ABSTRACT

In this combination process, solvent deasphalting (SDA) concentrates metals in the bottoms product which can be blended to asphalt as a product or for sending to the Calderon or similar process and outputs a high carbon (4+ concarbon) feed which is readily cracked to valuable transportation fuels by an RCC® cracking unit (or a conventional FCC with catalyst cooler and oxygen to the regenerator so that it acts as an RCC). The Rose process can be used instead of SDA to save utilities. By this invention, heavy crude can be converted to valuable transportation fuels and asphalt product, and catalyst make-up can be sharply reduced in the RCC or FCC unit because metals (asphalteries and porphyrins) are removed before cracking. Novel asphalt compositions and blending are also disclosed. Asphalt from the SDA can preferably be blended with lube plant extract (or other aromatic extract) to produce specific asphalts meeting new SHRP specifications for paving.

8 Claims, 6 Drawing Sheets

PERFORMANCE GRADED ASPHALT BINDER (AASHTO MP1)

| PERFORMANCE GRADE | PG-52 | | | | | | | PG-58 | | | | | PG-64 | | | | | PG-70 | | | |
|---|---|---|---|---|---|---|---|---|---|---|---|---|---|---|---|---|---|---|---|---|---|
| | -10 | -16 | -22 | -28 | -34 | -40 | -46 | -16 | -22 | -28 | -34 | -40 | -16 | -22 | -28 | -34 | -40 | -10 | -16 | -22 | -28 |
| 7 DAY MAX TEMP °C | <52 | | | | | | | <58 | | | | | <64 | | | | | <70 | | | |
| MIN TEMP °C | >-10 | >-16 | >-22 | >-28 | >-34 | >-40 | >-46 | >-16 | >-22 | >-28 | >-34 | >-40 | >-16 | >-22 | >-28 | >-34 | >-40 | >-10 | >-16 | >-22 | >-28 |
| ORIGINAL BINDER | | | | | | | | | | | | | | | | | | | | | |
| FLASH POINT | 230 | | | | | | | | | | | | | | | | | | | | |
| VISCOSITY TEST TEMP °C | 135 | | | | | | | | | | | | | | | | | | | | |
| DYNAMIC SHEAR | 52 | | | | | | | 58 | | | | | 64 | | | | | 70 | | | |
| ROLLING THIN FILM OVEN TEST RESIDUE (AASHTO T 240) | | | | | | | | | | | | | | | | | | | | | |
| MASS LOSS, MAX PERCENT | 1.0 | | | | | | | | | | | | | | | | | | | | |
| DYNAMIC SHEAR | 52 | | | | | | | 58 | | | | | 64 | | | | | 70 | | | |
| PRESSURE AGING VESSEL RESIDUE (AASHTO PP1) | | | | | | | | | | | | | | | | | | | | | |
| PAV AGING °C | 90 | | | | | | | 100 | | | | | 100 | | | | | 100/(110)°C | | | |
| DYNAMIC SHEAR | 25 | 22 | 19 | 16 | 13 | 10 | 7 | 25 | 22 | 19 | 16 | 13 | 28 | 25 | 22 | 19 | 16 | 34 | 31 | 28 | 25 |
| CREEP STIFFNESS | 0 | -6 | -12 | -18 | -24 | -30 | -36 | -6 | -12 | -18 | -24 | -30 | -6 | -12 | -18 | -24 | -30 | 0 | -6 | -12 | -18 |
| DIRECT TENSION | 0 | -6 | -12 | -18 | -24 | -30 | -36 | -6 | -12 | -18 | -24 | -30 | -6 | -12 | -18 | -24 | -30 | 0 | -6 | -12 | -18 |

FIG. 6

DEMETALLATION-HIGH CARBON CONVERSION PROCESS, APPARATUS AND ASPHALT PRODUCTS

BACKGROUND OF INVENTION

I. Field of the Invention

The present invention can be generally classified in U.S. Class 208, subclasses 73, 91, 86, 52, 55, 156, 85, 88, 251, and 67; and International Class C10G, subclasses 11/18, 51/02, 25/00, and 51/04.

II. Description of the Prior Art

U.S. Pat. No. 4,434,044 to L. E. Busch, P. W. Walters and O. J. Zandona (attorney docket 6107BUS); U.S. Pat. No. 4,525,268 to D. F. Barget (attorney docket 6107CUS); U.S. Pat. No. 4,569,753 to L. E. Busch, P. W. Walters, and O. J. Zandona (attorney docket 6107NUS); U.S. Pat. No. 4,894,141 to L. E. Busch, P. W. Walters, and O. J. Zandona (attorney docket 6107OUS) all teach the treatment of carbometallic oils containing high amounts of carbon and metals by contacting with fluidized solid sorbent materials in a first contactor, then cracking under short contact times with zeolite catalyst to produce hydrocarbon products in the transportation fuel ranges. The cracking of carbometallic oils, particularly by the RCC® heavy oil conversion process is taught in U.S. Pat. Nos. 4,347,122; 4,341,624; 4,414,098; 4,431,515; and 4,444,651. Sorbent contacting is taught in U.S. Pat. No. 4,427,539 to L. E. Busch and G. O. Henderson (attorney docket 6175AUS), and also in U.S. Pat. No. 4,513,093; 4,469,588; and 4,263,128.

U.S. Pat. No. 3,951,781 to Owen cracks SDA raffinate plus hydrogen contributors ($CH_4$, $C_2H_6$, $CH_3OH$, etc.) to produce gasoline, etc.

U.S. Pat. No. 5,135,640 to Vizner (Texaco) vacuum distills a topped crude and solvent refines the resulting virgin vacuum gas oil which is then catalytically cracked, and also deasphalts vacuum resid product from the vacuum distillation and passes the deasphalted vacuum resid to catalytic cracking.

Solvent deasphalting (extraction of asphalts from heavy petroleum stocks) is a well-known petroleum process and is described in U.S. Pat. No. 3,951,781 to Owen (Mobil); U.S. Pat. No. 3,968,023 to Yan (Mobil); U.S. Pat. No. 3,972,807 to Uitti (UOP); U.S. Pat. No. 3,975,396 to Bushnell (Exxon); U.S. Pat. No. 3,981,797 to Kellar (UOP); U.S. Pat. No. 3,998,726 to Bunas (UOP); U.S. Pat. No. 4,017,383 to Beavon (Ralph M. Parsons); U.S. Pat. No. 4,054,512 to Dugan (Exxon); U.S. Pat. No. 4,101,415 to Crowley (Phillips); U.S. 4,125,458 to Bushnell (Exxon); and numerous others. Specific proprietary processes include the SOLVAHL solvent deasphalting process licensed by Institute Francais de Petrole, the low-energy deasphalting process licensed by Foster Wheeler, U.S.A., shown schematically in FIG. 1. Deasphalting processes also include the ROSE supercritical fluid technology licensed by Kerr-McGee Corporation.

Lube oil processes (FIG. 3) are commonly licensed by Texaco Development Company and Mobil Research and Development Corporation using a zeolite-based catalyst to reduce the pour point of the oil by removing waxy components and thereafter hydrotreating in a second reactor to stabilize the dewaxed oil. Exxon licenses the Exol N extraction process for selective extraction of raw lube stocks by extraction followed by treater tower in which solvent is recovered from both extract and raffinate phases by flashing and stripping with gas. Extraction solvent water content is adjusted to optimize results. (Each of these processes is shown in the Refining Handbook, November 1992, published by Hydrocarbon Process magazine.)

SUMMARY OF THE INVENTION

I. General Statement of the Invention

According to the invention, solvent deasphalting (SDA) of a feed such as vacuum bottoms (the bottoms from a vacuum distillation), concentrates metals in the bottoms product which can be blended to asphalt after which the lighter products can be cracked to valuable transportation fuels by a heavy oil cracking unit such as an RCC® process unit or a conventional fluid catalytic cracker (FCC) with a catalyst cooler and preferably some oxygen fed to the regenerator so that it acts like an RCC or similar heavy oil cracker. By this invention, heavy crude oil can be converted to valuable transportation fuels and valuable asphalt products, and catalyst makeup can be sharply reduced in the cracking step because metals (from asphaltenes and porphyrins), which accumulate on catalyst and shorten catalyst life, raising catalyst costs, are removed from the cracker feed before the cracking step.

Additionally, it has now been found that by blending of the bottoms (asphalts) produced by the above process with aromatic extract, preferably produced from an extraction process such as lubricating oil production, asphalts can be produced which have superior characteristics. Particularly, these novel asphalts are useful for meeting the new SHRP specifications for dynamic sheer, creep stiffness, and direct tension (tensile strength). As the new SHRP asphalt specifications impact the marketplace, particularly aided by the recent increases in federal funds for highway construction and repair, these new asphalt products will be particularly advantageous.

Preferred stated briefly, the invention comprises a process for upgrading carbometallic topped crude oil by a combination of distillation, extraction and cracking to produce products of lower molecular weight boiling in the transportation fuel range and conjointly produce enhanced asphalts, which comprises the steps of:

a. vacuum distilling said topped crude oil to produce an overhead product comprising hydrocarbons boiling in the range of about 340°–540° C. (650°–1000° F.) and a bottoms product comprising hydrocarbons boiling above about 450° C. (850° F.), comprising metal contaminants in excess of 100 ppm, comprising concarbon in excess of 15%;

b. extracting by intimate contact with a solvent under a pressure sufficient to maintain a liquid phase to produce a substantially insoluble product comprising asphaltenes and a substantially soluble product comprising deasphalted oil;

c. thereafter reducing the pressure on said substantially soluble product in a reduced pressure zone to recover a lower boiling fraction comprising at least about 90% of said solvent, and a higher boiling deasphalted oil boiling in the range above about 540° C. (1004° F.);

d. introducing the deasphalted oil into a zone of higher temperature to distill off a lower boiling product comprising additional quantities of said solvent, and a higher boiling bottoms product comprising stripped deasphalted oil;

e. heating the substantially insoluble bottoms product from said extracting step to a temperature in the range of about 200° to 370° C. (400° to 700° F.);

f. introducing the heated insoluble product into a reduced pressure zone wherein an overheads product is produced, said overheads product comprising at least about 90% of said solvent, and a bottoms asphalt product boiling in the range above about 540° C. (1004° F.);

g. introducing the asphalt product into a zone of lower pressure or contact with steam to produce an overhead product comprising still additional quantities of said solvent and a higher boiling product comprising pitch;

h. introducing the deasphalted oil into a riser contactor;

i. contacting the deasphalted oil product for about 0.5 to about 5.0 seconds at a temperature of about 900°–1100° F. with a zeolite-containing catalyst having a matrix comprising alumina to produce products of lower molecular weight of deasphalted oil and to produce products comprising transportation fuels, light gases, and slurry oil comprising catalyst fines and hydrocarbons boiling in the range of about 630° F. to about 1000° F.

Preferred, more preferred and most preferred ranges for each of the parameters discussed above are set forth in Table A.

The invention additionally comprises special asphalt compositions of high specification, particularly asphalt compositions capable of meeting the SHRP specifications discussed above. Stated briefly, these include asphalt compositions containing from about 0.5% to about 50% of a lube plant extract boiling in the range of 121°–704° C. (200°–1300° F.) and about 0.5% to about 95% of an asphalt product boiling above about 510° C. (950° F.), and having a viscosity of about 200 to 5000 poise, wherein the bottoms product comprises hydrocarbons boiling above about 950° F.

Table B sets forth the preferred, more preferred and most preferred ranges of the asphalt compositions of the invention.

Suitable feeds comprise vacuum tower bottoms, reduced crude (atmospheric); topped crude, and preferably hydrocarbons comprising initial boiling point of about 450° C. (850° F.) or above.

The extraction-step products can comprise heavy gas oils; AC5 asphalts; aromatic extracts such as 330 extract; bright stock, etc. that can preferably be from a lube oil plant but can be from other extraction steps in hydrocarbon refining processes.

The fuel products produced in the conversion step will preferably be transportation fuels such as kerosene, jet fuels, diesel fuels, gasoline, and the like.

The asphalt products will preferably be as shown in FIG. 6 which summarizes the new SHRP specifications with their requirements of dynamic sheer, creep stiffness, and direct tension.

II. Utility of the Invention

The present invention is useful for the production of transportation fuels and valuable high-specification asphalts.

BRIEF DESCRIPTION OF THE DRAWINGS

FIG. 6 is a summary of SHRP asphalt binder specifications.

DESCRIPTION OF THE PREFERRED EMBODIMENTS

EXAMPLE 1

The Invention

Figure 1:
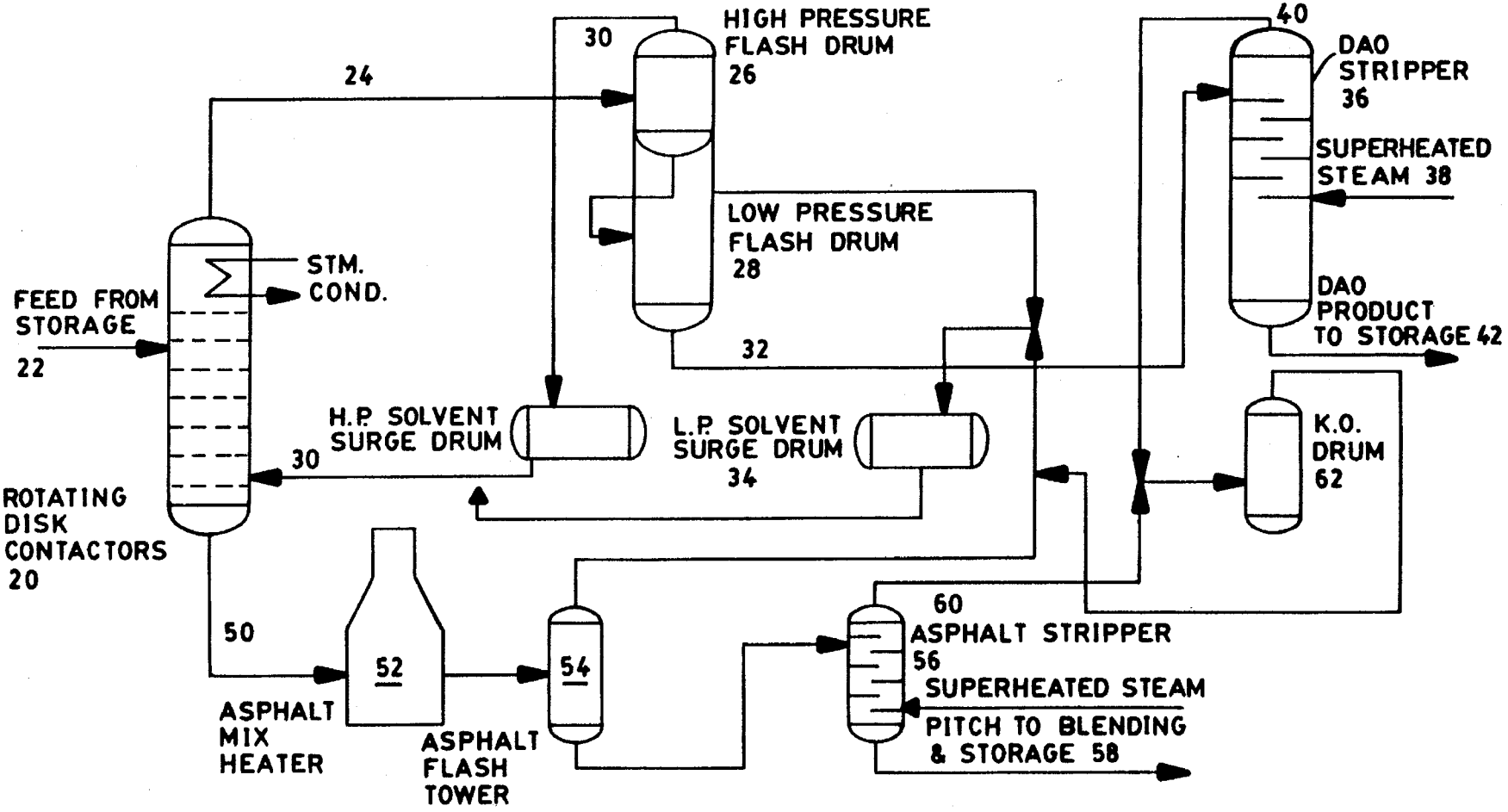
FIG. 1 is a schematic diagram of a typical Foster Wheeler solvent deasphalting (SDA) unit.

Referring to FIG. 1, a conventional solvent deasphalting (SDA) unit (process licensed from Foster Wheeler) comprises disc contactor 20 in which feed from storage 22, preferably vacuum tower bottoms boiling above about 538° C. (1000° F.), is contacted with high pressure solvent comprising butane, pentane, hexane, heptane, or mixtures thereof at temperature of about 93°–148° C. (200°–300° F.) at a pressure above the vapor pressure of the solvent. Overheads 24 from the rotating disc contactor are sent to high pressure flash drum 26 and low pressure flash drum 28 where an overhead 30 is removed for recycle back to the rotating disc contactor 20 as high pressure solvent 30. The low pressure solvent 32 goes to low pressure solvent surge drum 34 and can also be recycled as high pressure solvent 30. Low pressure solvent 32 goes to the deasphalted oil (DAO) stripper 36 where it is treated with superheated steam 38 to produce an overhead 40 which is residual solvent for recovery and recycle, and a bottoms DAO product 42 which is sent to storage.

Figure 3:
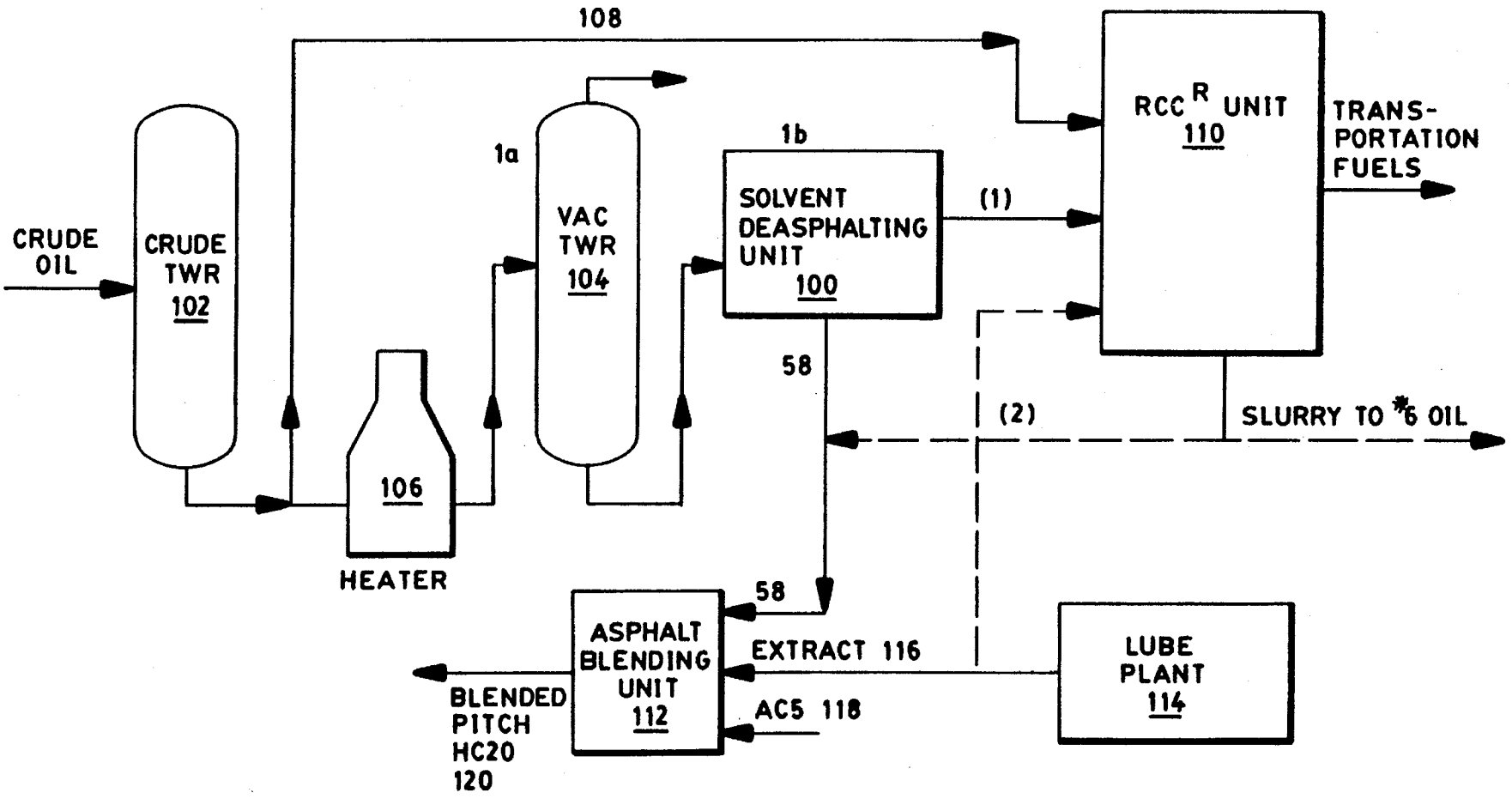
FIG. 3 shows the invention processing crude tower bottoms with solvent deasphalting and lube oil plant extraction and shows the interconnection of recycles and products from the various steps SDA 100, RCC 110, and Lube Plant 114.

The bottoms 50 from rotating disc contactor 20 are passed through asphalt mix heater 52 and asphalt flash tower 54 to asphalt stripper 56 which is fed superheated steam and produces a bottoms pitch 58 for blending and storage, and an overhead 60 which is sent through knock-out drum 62 for recycle back to the asphalt flash tower. FIG. 3 shows the entire solvent deasphalting unit 100 as a single box fed by crude oil fractions passing through crude tower 102 and vacuum tower 104 with intermediate heater 106. A portion of the crude tower bottoms, atmospheric tower reduced crude 108 is sent to the RCC unit 110, described in more detail in U.S. Pat. Nos. 4,347,122, 4,341,624, 4,414,098, 4,431,515, or 4,444,651. As shown in FIG. 3, pitch 58, described with reference to FIG. 1, flows from the solvent deasphalting unit 100 into asphalt blending unit 112. A lube plant 114 extracting with sulfolane, furrural, or the like (described more fully in Petroleum Processing Handbook, pp 3-86–3-87, 1967), produces an extract 116 which is also sent to the asphalt blending unit. (For ease in pumping, a portion of extract 116 may be blended with pitch 58 to reduce its viscosity prior to pumping into asphalt blending unit 112.)

Preferably, a stream of asphalt cement of 500 poises viscosity at 140° F. is additionally added to asphalt blending unit 112, though the asphalt blending unit can produce AC20 (or 40, or whatever is desired for the product specifications at the time) by blending pitch 58 only with extract 116.

While FIG. 3 shows lube plant 114, another extraction unit producing aromatics from a variety of heavy petroleum streams (such as a furrural, sulfolane extractor, an N-methylpyrolidone, or other aprotic solvent extractor) can be substituted for the lube plant.

Dotted line 1 shows an alternate processing of the pitch from the SDA if slurry from the RCC (or other cracking unit) can be used as a diluent. Still a further alternative is to feed the extract to a fluid catalytic cracker (FCC), with or without hydrotreating the extract. The line marked "(2)" shows an alternate addition of slurry oil to the asphalt blending where this can be done and still produce an on-spec blended pitch 120, such as AC20.

EXAMPLE 2

Conventional Chide Tower and Vacuum Bottoms Processing without SDA)

Figure 2:
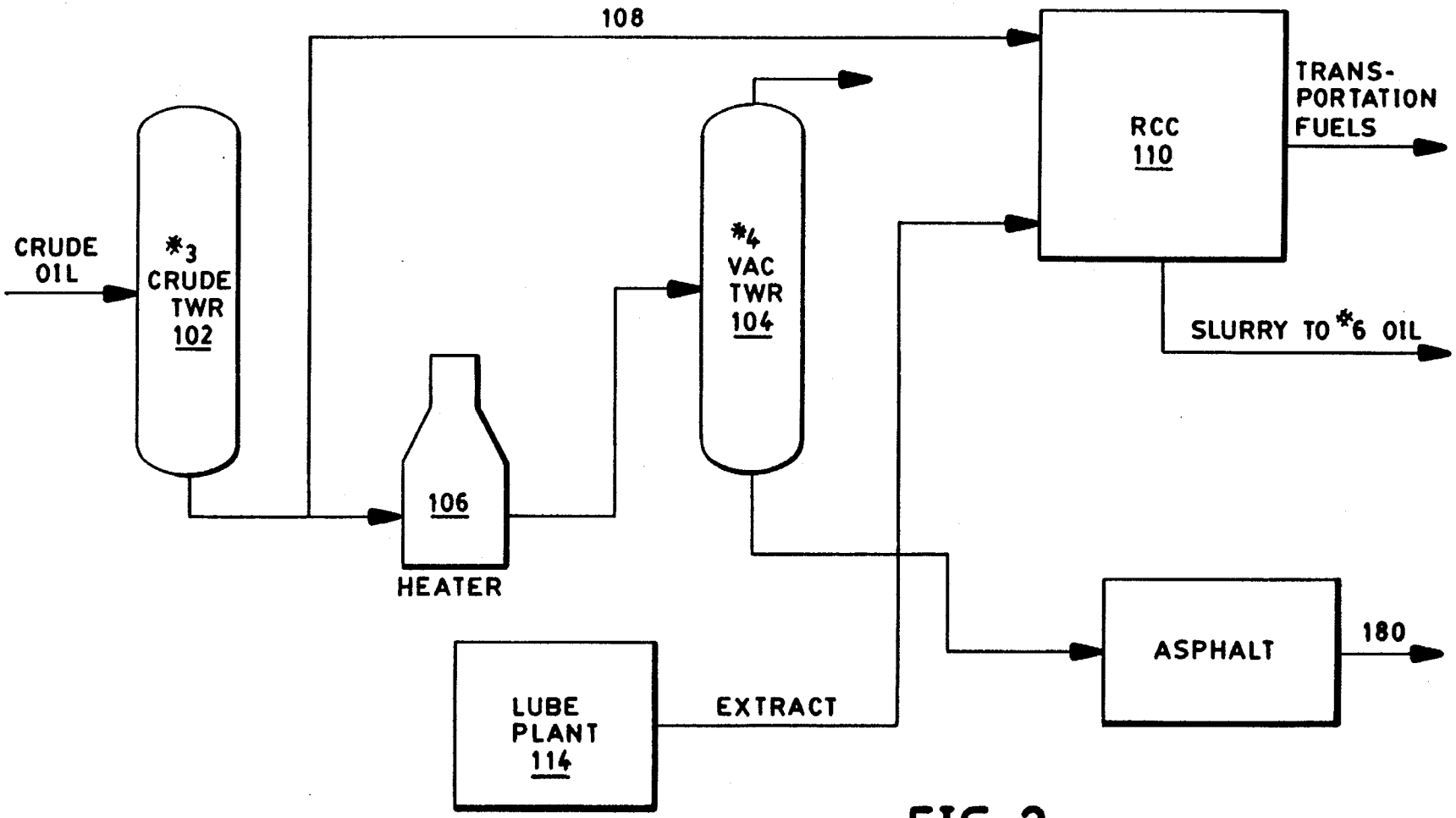
FIG. 2 is a schematic diagram of a crude tower bottoms (topped crude) processing apparatus of conventional design without utilizing the solvent deasphalting step of the present invention.

Referring to FIG. 2, and using, where applicable, the same numbers used in describing FIGS. 1 & 3, crude oil is fractionated in crude tower 102, heater 106, and vacuum tower 104 to produce crude tower bottoms (atmospheric reduced crude) and vacuum gas oil 108 which is fed to FCC unit 110, which produces transportation fuels and produces slurry oil which is sent to be mixed with no. 6 oil for sale. There is no solvent deasphalting unit in this schematic diagram, FIG. 2. Vacuum tower bottoms are sent directly to asphalt product (with or without an oxidation step, depending on the particular crude being processed). Because there is no SDA extract (such as extract 116 shown in FIG. 3), the way to vary the asphalt product 180 is by varying the conditions in vacuum tower 104. For example, the asphalt can be made to have a higher viscosity by operating the vacuum tower at a higher temperature and/or lower pressure to remove more heavies as overhead from the vacuum tower. Alternatively, the asphalt can be increased in viscosity by oxidizing it (Petroleum Refinery Engineering, 4th Edition, Chemical Engineering Series, W. L. Nelson, McGraw-Hill, page 261). While this suffices for most 1980 or earlier asphalt specifications, it is difficult to meet the new SHRP specifications merely by altering the temperature and pressure of the vacuum tower, or even by oxidation. Further, SHRP specifications may in many cases prevent the oxidation of the asphalt. In such instances, the methods of varying the properties of the finished asphalt to meet desired specifications will be to adjust conditions in the vacuum tower, to actually purchase crudes suited for producing the particular asphalt product desired, and/or to add relatively expensive polymer additives to the asphalt.

As shown in Example 1, the present invention provides unprecedented flexibility in asphalt blending by using relatively low valued extracts to vary the properties of the finished asphalt.

EXAMPLE 3

Invention—High Specification Asphalt Product

Figure 5:
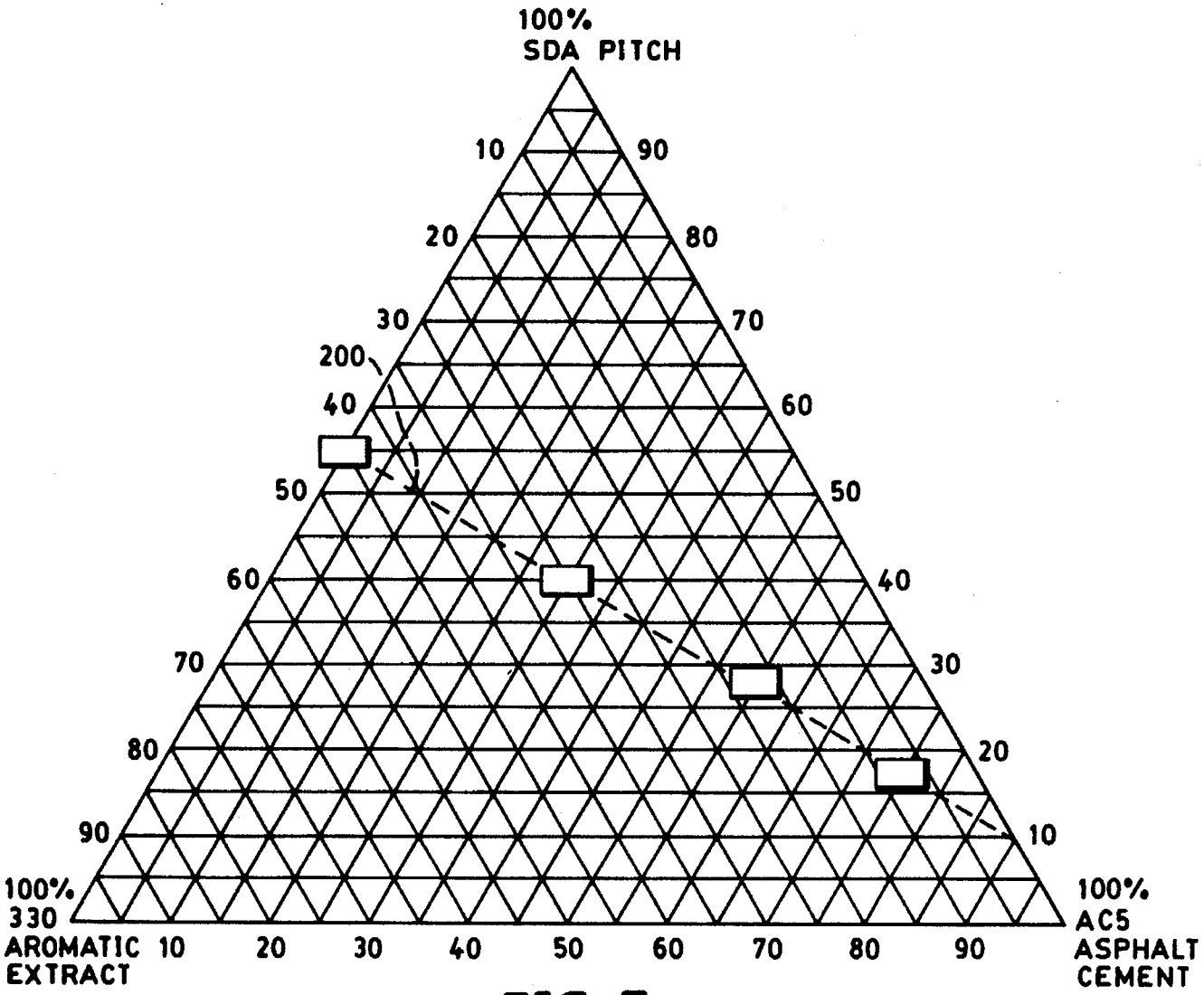
FIG. 5 is a ternary mixture diagram of SDA bottoms, aromatic concentrate which is extracted from waxy distillate (WD) which, after dewaxing, produces a wax-free lube oil preferably having a viscosity at 330 sus at 100° F. (330 extract), and 500 sus viscosity asphalt cement (AC5) to produce 2000 poises asphalt cement at 140° F. (60° C.) (AC20) product useful for paving asphalt.

FIG. 5 is a ternary mixture diagram for the SDA pitch 58, the 330 extract 116, and the AC5 118 all as described in Example 1, according to the invention.

The AC5 may be made by the conventional process of FIG. 2, operating without a solvent deasphalting unit.

The dotted line 200 is the approximate center point for meeting the existing AC20 specification. While some tolerance is allowed, best AC20 quality would fall on this line.

Figure 4:
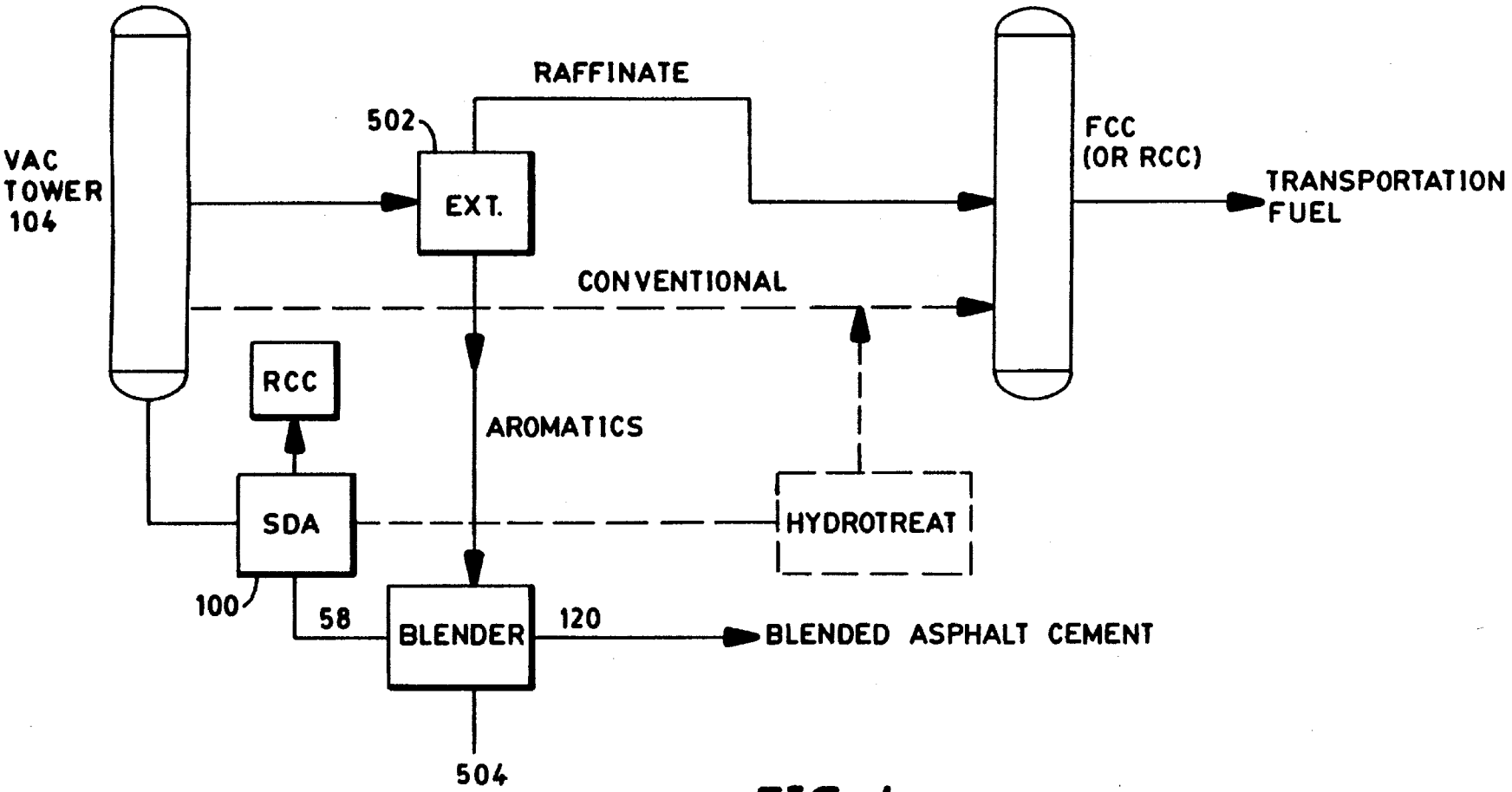
FIG. 4 shows the invention processing crude tower bottoms with solvent deasphalting and aromatics extraction as an alternative to the process of FIG. 3.

Referring to FIG. 6 which is a brief summary of the new SHRP specifications, it can be seen that the difficulty in making AC20 specifications is compounded many times over. Referring to FIG. 4, the difficulty in making a particular asphalt without the blending step of the present invention is illustrated by considering the diagram. Without being able to blend, the entire ternary diagram collapses into the single point marked AC5 asphalt cement. Adding SDA pitch, allows one to move along the line between AC5 and SDA, permitting some variation and producing AC20 by mixing about 10% SDA pitch with the AC5, but this is only at a single point, a single composition. Adding the aromatic extract taught by the present invention permits the use of the entire ternary diagram and AC20 can be made in a virtually infinite number of compositions stretching across the diagram as shown by dotted line 200.

EXAMPLE 4

Invention—without lube plant

FIG. 4 shows schematically an alternative which omits the lube plant extract feed from the process of FIG. 3 described in Example 1.

Referring to FIG. 4, vacuum tower 104 receives feed from a crude tower (not shown) and outputs bottoms to an SDA unit 100 similar to that shown in FIG. 1 and described in Example 1. Vacuum tower 104 also outputs a midstream which goes to extractor 502 which produces a raffinate sent to an FCC or RCC fluid cracking unit to produce transportation fuels. (In conventional operation, the dotted line marked conventional would be employed to bypass the extractor and send vacuum tower midcut directly to the FCC or RCC.) The SDA also outputs overhead deasphalted oil which can be sent to FCC or RCC.

The extractor 502 produces an aromatics cut which is sent to blender 504. The SDA produces a pitch 58 (similar to that produced in FIG. 1 ) which is also sent to the blender 504. In blender 504, the aromatics from extractor 502 and the pitch 58 from SDA unit 100 are blended together in proportions according to a diagram similar to FIG. 4 to produce a blended asphalt cement meeting the described SHRP or similar specification, such as AC20. Properties of the aromatics cut can be tailored as needed by the operation of vacuum tower 104.

Alternatively, the SDA deasphalted oil can be output to a hydrotreater (shown in dotted line only) which can then produce a hydrotreated stream for blending with conventional vacuum tower gas oil, raffinate, or any conventional FCC feed stream to feed the FCC unit 150.

Modifications

Specific compositions, methods, or embodiments discussed are intended to be only illustrative of the invention disclosed by this specification. Variation on these compositions, methods, or embodiments are readily apparent to a person of skill in the art based upon the teachings of this specification and are therefore intended to be included as part of the inventions disclosed herein.

Reference to documents made in the specification is intended to result in such patents or literature being expressly incorporated herein by reference including any patents or other literature references cited within such documents.

Particularly useful is the addition of styrene butadiene copolymers or SBS (styrene butadiene styrene) to the blended asphalt products of the present invention. While the invention is not to be limited to any theory, these copolymers apparently cause polymerization with the solvent deasphalted blends of the invention, and the aromatic oils in the asphalt blends help to solubilize the copolymers into the asphalt, providing substantially improved stability. The added polymers can be vulcanized in situ with the asphalt by using sulfur and accelerators. Suitable polymers include styrenebutadiene, polysulfides such as ditertiododecyl pentasulfide or dinonyl pentasulfide such as those taught in U.S. Pat. No. 4,554,313 to Hagenbach (assigned Elf; U.S. Pat. No. 4,242,246 to Maldonado (Elf); U.S. Pat. No. 4,162,999 to Bohemen (British Petroleum); U.S. Pat. No. 5,120,777 to Chaverot (Elf); U.S. Pat. No. 4,567,222 to Hagenbach (Elf); U.S. Pat. No. 5,118,733 to Gelles (Shell); U.S. Pat. No. 5,039,342 to Jelling (National Patent Development); U.S. Pat. No. 5,023,282 to Neubert (GenCorp); U.S. Pat. No. 3,238,173 to Bailey (Shell); U.S. Pat. No. 4,585,816 to Vitkuske (Dow Chemical) (diene/vinyl aromatic block copolymers, e.g. methylstyrene, tertiary butyl styrene, etc.); U.S. Pat. No. 5,059,300 to McGinnis (Chevron) (phosphoric acid); U.S. Pat. No. 4,393,155 to Garrett (Ashland Oil) (polyacrylamides).

TABLE A

| | | PROCESS | | |
|---|---|---|---|---|
| Parameter | Units | Preferred | More Preferred | Most Preferred |
| EXTRACTION | | | | |
| Overhead Boiling Range | °F. | 650–1000 | — | — |
| Bottoms Boiling Range | °F. | above 850 | 500–600 | — |
| Metals | ppm | above 10 | above 500 | above 1000 |
| Concarbon | % | above 4 | above 10 | above 20 |
| Extraction Pressure | psig | maintain liquid | 100–1000 | 150–900; 200–800 |
| Deasphalted Oil Boiling Range | °F. | above 1004 | above 1100 | above 1200 |
| HEATING | | | | |
| Temperature | °F. | 400–700 | 500–600 | 550–650 |
| REDUCING PRESSURE | | | | |
| Percent Solvent in Overhead | % | above 90 | above 95 | above 97 |
| CRACKING | | | | |
| Contact Time | sec. | 0.5–5 | 1–4 | 1.5–3 |
| Temperature | °F. | 900–1100 | 950–1050 | 980–1030 |
| Boiling Range | °F. | 630–1100 | 650–1050 | 700–1000 |

TABLE B

| | | ASPHALT COMPOSITIONS | | |
|---|---|---|---|---|
| Parameter | Units | Preferred | More Preferred | Most Preferred |
| Extract | % wt. | 0.5–50 | 3–30 | 5–25 |
| Extracting Boiling Range | °F. | 200–1300 | 250–1150 | 300–1100 |
| Asphalt Product | % wt. | 0.5–95 | 5–80 | 10–70 |
| Asphalt Product Boiling Pt. | °F. | above 950 | above 1000 | above 1050 |
| Asphalt Viscosity | poise | 200–5000 | 250–4000 | 300–3000 |

I claim:

1. A process for upgrading carbometallic topped crude oil by a combination of distillation, extraction and cracking to produce products of lower molecular weight boiling in the transportation fuel range and conjointly produce enhanced asphalts, said process comprising in combination:

a) vacuum distilling said topped crude oil to produce separately an overhead product comprising hydrocarbons boiling in the range of about 340°–540° C. (650°–1000° F.) and a bottoms product comprising hydrocarbons boiling above about 450° C. (850° F.), comprising metal contaminants in excess of 10 ppm and comprising concarbon in excess of 4%;

b) extracting said bottoms product from step a by intimate contact with a solvent under a pressure sufficient to maintain a liquid phase to produce separately a substantially insoluble product comprising asphaltenes and a substantially soluble product comprising deasphalted oil;

c) thereafter reducing the pressure on said substantially soluble product in a reduced pressure zone to recover a lower boiling fraction comprising at least about 90% of said solvent, and a higher boiling deasphalted oil boiling in the range above about 540° C. (1004° F.);

d) introducing said deasphalted oil into a zone of higher temperature to distill off a lower boiling product comprising additional quantities of said solvent, and a higher boiling bottoms product comprising stripped deasphalted oil;

e) heating said substantially insoluble product from extracting step b to a temperature in the range of about 200°–370° C. (400°–700° F.);

f) introducing said heated insoluble product into a reduced pressure zone wherein an overheads product is produced, said overheads product comprising at least about 90% of said solvent, and a bottoms asphalt product boiling in the range above about 540° C. (1004° F.);

g) introducing said asphalt product into a zone of lower pressure or contact with steam to produce an overhead product comprising still additional quantities of said solvent and a higher boiling product comprising pitch;

h) contacting said stripped deasphalted oil product from step d in a riser contactor for about 0.5 to about 5.0 seconds at a temperature of about 900°–1100° F. with a zeolite-containing catalyst having a matrix comprising alumina and/or silica to produce products of lower molecular weight then said deasphalted oil and to produce products comprising transportation fuels, light gases, and slurry oil comprising catalyst tines and hydrocarbons boiling in the range of about 330°–540° C. (630° F. to about 1100° F.).

2. A process according to claim 1 wherein the solvent recovered from step c and the solvent recovered from step d are combined and recycled to said extracting step b.

3. A process according to claim 1 wherein a portion of the products from step h are recycled as solvent to extracting step b.

4. A process according to claim 1 additionally comprising:

a) a portion of the overhead product from said vacuum distilling step a, is separated and processed in a lube oil manufacturing plant in which solvent extraction is utilized to produce a lube plant extract, and wherein a portion of said lube plant extract is blended with substantially insoluble product from extracting step b to produce an asphalt product having enhanced consistency.

5. A process according to claim 1 wherein the extracting step is conducted under a pressure in the range of from about 0.7–7 million N/mm$^2$ (100–1000 psig); and wherein said catalyst comprises both zeolite and active alumina and wherein said substantially insoluble product from said extraction step is heated to about 260°–315° C. (500°–600° F.).

6. A process according to claim 1 wherein that an extracting step is conducted under a pressure in the range of from about 1–10 million N/mm$^2$ (150–900 psig); and wherein said catalyst comprises both zeolite and active alumina.

7. A process according to claim 1 wherein the extracting step is conducted under a pressure in the range of from about 1.4–5 million N/mm$^2$ (200–800 psig); and wherein said catalyst comprises both zeolite and active alumina.

8. A process according to claim 1 in which the metal contaminants are in excess of 500 ppm and the insoluble product from said extracting step b is heated to a temperature in the range of about 260°–315° C. (500°–600° F.) and wherein said extract comprises a lube plant extract.

* * * * *